US005080399A

United States Patent [19]

Olson

[11] Patent Number: 5,080,399

[45] Date of Patent: Jan. 14, 1992

[54] SYSTEM FOR SERIALLY INDEX-MARKING PUBLICATIONS

[76] Inventor: Craig W. Olson, P.O. Box 302, Fontana on Geneva Lake, Wis. 53125

[21] Appl. No.: 599,734

[22] Filed: Oct. 19, 1990

[51] Int. Cl.[5] ..... B42D 15/00

[52] U.S. Cl. ..... 283/70; 283/67

[58] Field of Search ..... 283/67, 70, 81; 156/64

[56] References Cited

U.S. PATENT DOCUMENTS

| | | | |
|---|---|---|---|
| 4,240,848 | 12/1980 | Barber | 154/64 |
| 4,329,191 | 3/1982 | Barber | 154/64 |
| 4,438,950 | 3/1984 | Hamisch, Jr. | 283/70 |
| 4,580,815 | 4/1986 | Barber | 283/81 |
| 4,824,503 | 4/1989 | Wilen | 283/67 |
| 4,936,608 | 1/1990 | Gensel et al. | 283/70 |

FOREIGN PATENT DOCUMENTS

| | | | |
|---|---|---|---|
| 2077659 | 12/1981 | United Kingdom | 283/70 |

*Primary Examiner*—Timothy V. Eley
*Assistant Examiner*—Willmon Fridie, Jr.

[57] ABSTRACT

A process for serially index-marking a system of publications for filing paginated and non-paginated publications for the system comprises imprinting directly one or both faces (11, 12) of marker members (10) or imprinting a label (20) to indirectly apply the field information to a marker's face or faces. Each of the marker members having a primary field and/or at least one sub-field on at least one marker's face. The primary field (25) and sub-field (26) comprising at least one pair of readable indicia elements being mutually corresponding in each field. Each machine readable imprinted marker member for a certain publication is differentiated from other publication markers for the same publication and different publications for the system by assignment of different pairs of readable indicia to each marker member being peculiar to and representative of each marker. The pairs of indicia imprinted and carried in the fields consist of one machine readable indicia element (30) with one corresponding visually readable indicia element (30*a*) having a pre-determined associative relationship. The fields of indicia pairs imprinted are predetermined to appear upright to one pre-selected marker edge which extends beyond the physical edge of the respective publication (50).

21 Claims, 2 Drawing Sheets

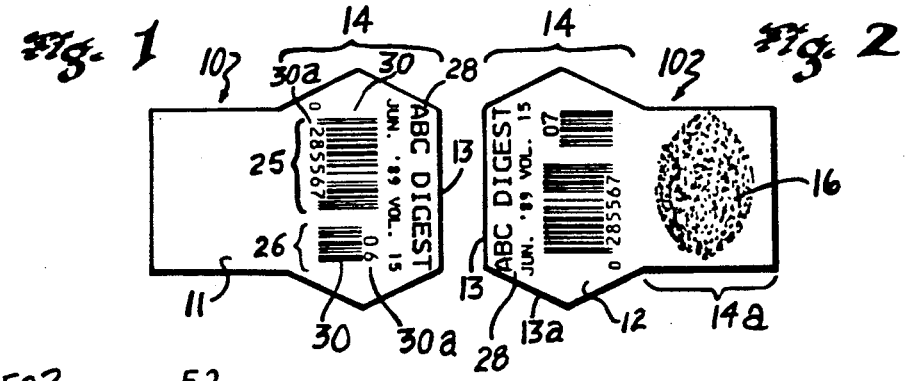
Fig. 1
Fig. 2
14
14
10
10
30a
30
28
ABC DIGEST
JUN. '89 VOL. 15
25
26
13
11
30
30a
16
13
13a
12
14a
28
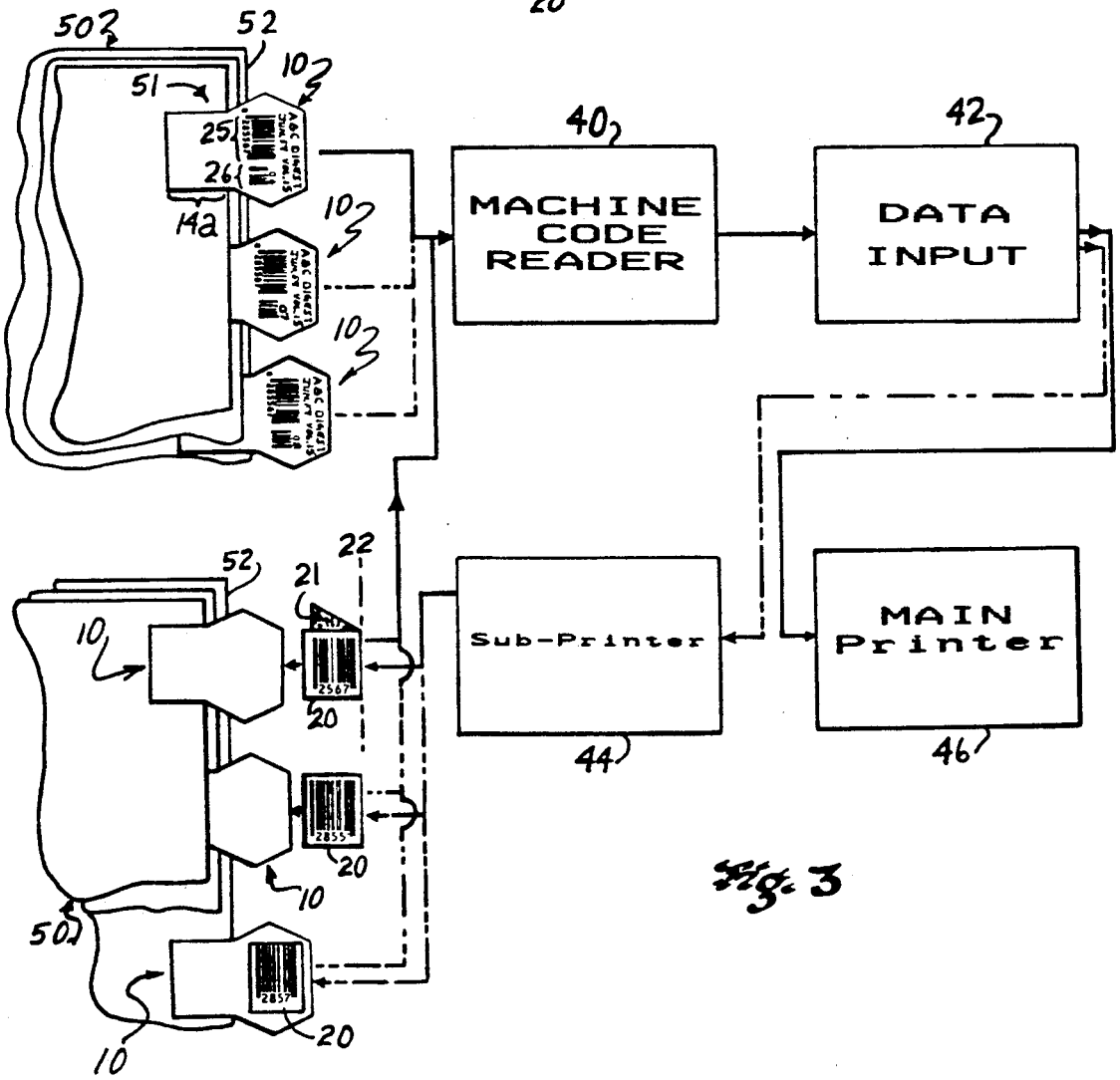
50
52
51
10
25
26
14a
40
MACHINE CODE READER
42
DATA INPUT
22
21
20
Sub-Printer
MAIN Printer
44
46
Fig. 3

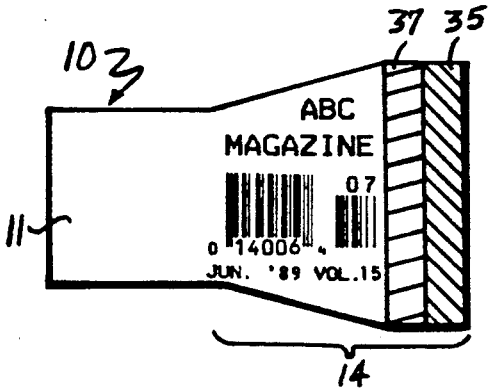
Fig. 4
Fig. 5
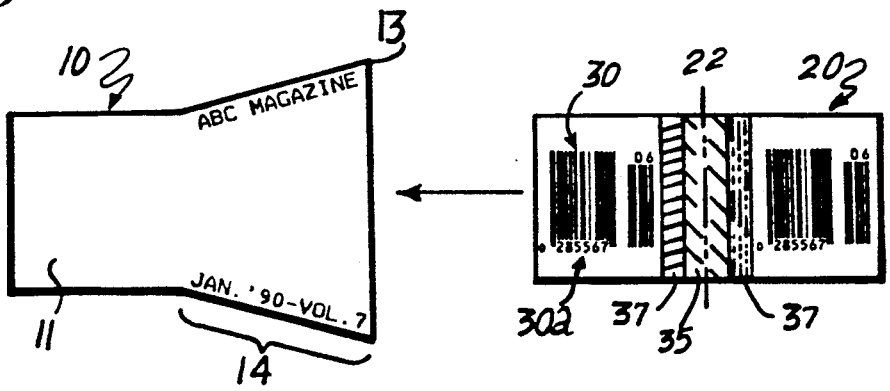
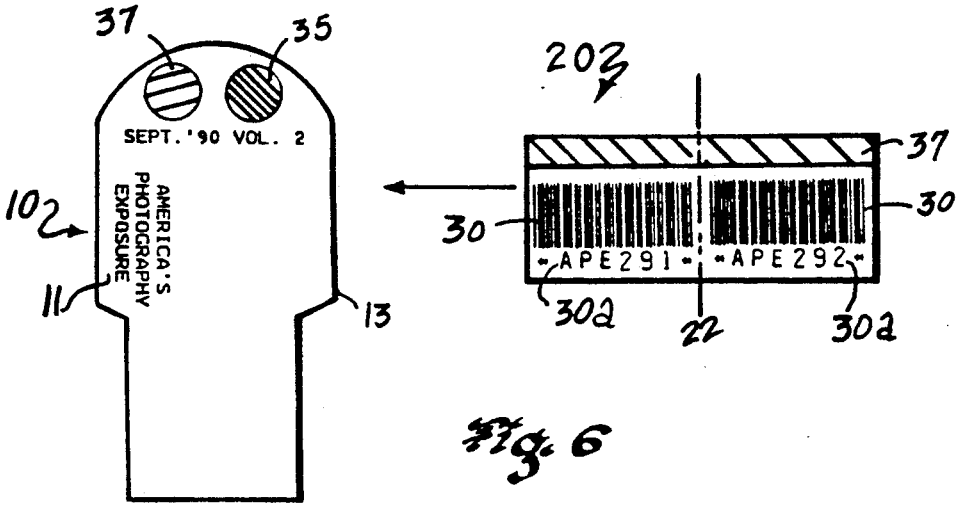
Fig. 6

SYSTEM FOR SERIALLY INDEX-MARKING PUBLICATIONS

FIELD OF THE INVENTION

This invention relates to a process for serially index-marking a filing system of publications and to directly or indirectly applying serial indicia to the markers by imprinting.

BACKGROUND OF THE INVENTION

In general, there are two methods to file paginated and non-paginated publications; both publication types are information-containing vessels which are found in the home and/or office and lend themselves to being utilized as a personal library of current reference material capable of being accessed at any given moment. One method is to insert the publications, each in their own file folder, placing the file folders juxtaposed in file drawers. The other method is to individually place them juxtaposed in a storage receptacle which may be a floor container or shelf file system.

Although both the file folder system for file drawers and shelf files have been accepted practice for home and office use, limitations exist when attempting to re-locate or inventory voluminous publications stored collectively in series, regardless of their binding type, especially upon actuated demand. Typically perfect bound periodicals are stored with their binding facing outward toward the asile whereby information is printed usually along the elongated spine; saddle-stitched publications by mechanical stitched design do not provide for such planar area to imprint such information, require the user to randomly pull each issue from the shelf file to read the pertinent issue information located on the outside front cover panel. Due to machining design, the perfect bound (glued spine) and saddle-stitched spine are incompatable when stored collectively in a storage receptacle. It is highly unlikely that most homes or offices which save particular publication issues would separate and distinguish one binding type from another, to ease in later retrieval thereof; such as the type of organized filing receptacles (shelf or drawer) a library or institution would provide.

Further, should a file drawer method be used, the consumer is expected to purchase or obtain a file folder first prior to the publication insertion therein; the file folder being the common vehicle to "create" compatability among both perfect bound and saddle-stitched publications which are generally of standard length and width dimensions (usually less than the physical size of the receiving file folder itself). As for compact disc-containers, stamp and coin collection albums and other non-paginated publications they are typically stored uniformily with the imprinted binding spines on shelf files, facing the asile, as well. The ability to re-locate and inventory these paginated and non-paginated publications using index-markers using serially machine coded and readable indicia is key in this specification permitting rapid retrieval and access of specific publications desired upon demand using this process.

In storage filing of publications having both perfect bindings and saddle-stitched bindings, there is a diffi-cency to distinguish one issue from another in such a mixed arrangement since there are no "end tabs" or "side tabs" which would provide such distinguishment when the publications are stored juxtaposed in file (without being inserted into a file folder jacket). Commonly the paginated publications are positioned in storage with the fore-edge (the edge opposite the spine) facing the user thus protecting the publication cover from detachment yet, however, creating the problem of individual publication indentification. Regardless if such a collective mix of publications were filed with their unlike bindings exposed the problem of relocating and easily inventorying such saved publications in storage when the demand arises is still a manual, time-consuming task.

There are two principal readable systems or types of coding for re-location of publication information. These are by (a) the employment of visually readable graphics/character recognition such as numeric, alphabetic, alpha-numeric, color-coding and/or combination thereof; and (b) machine readable graphics or character recognition as in bar-codes, magnetic inks, electroconductive inks, etc.

Computers are being utilized for access, retrieval and inventory control of the information and its physical whereabouts which are recorded and stored in computer memory. This is presently accomplished by laser wand entry, key board entry, of the file reference numbers and their associative machine readable code indicia with corresponding visually readable reference coding, thus providing a cross-reference capability in the course of information retrieval. Other manual systems are time consuming and less efficient for the researcher of the required information, which may provide extensive problems to the individual to relocated "mixed" publications stored in a file receptacle or receptacles over a period of months or years. This lack of time and inability to relocate the desired information may truly discourage the researcher and the information hunt may well prove to be worthless; therefore the information stored in the valuable publications is likely to be discarded early before its useful life has been exhausted.

Typically paginated publications such as periodicals, books, etc. include a table of contents, index page of subject matter or advertisers or feature an outside cover index with page numbers of feature articles with the issue. It is unique, however, to utilize with a publication or use provided by a publication, machine readable indicia indexing-markers in a series to a publication or in series for the system of filing providing rapid re-location, inventory control and immediate access of the desired publication as needed by the user, as applicant describes in co-pending U.S. patent applications Ser. Nos. (C-I-P) 388,319 filed July 31, 1989, now U.S. Pat. No. 5,011,189 issued Apr. 30, 1991, and 504,912 filed Mar. 30, 1990, now U.S. Pat. No. 5,056,824 issued Oct. 15, 1991.

Canadian Patent 925,764 shows a label for a file folder flap. This label is one-sided and has printed thereon a name and two color coded areas which are representative of the first two initials of the surname. However, no consideration is given in that patent to the machine reading of information set out on the label and using such machine read information to (a) regulating by identifying a publication through such machine reading step the input directing serially index-markers to specific predetermined placement on such respective publication's border margin; (b) controlling from such reading step a user's application of sequential selected marker members, as adheringly applied, to the publication's border margin adjeacent the respective edge thereof.

U.S. Pat. No. 3,949,363 discloses various types of bar code, magnetic ink character recognition and optical character recognition printing used on cheques and the like. The particulars of the coded information may be read from the cheque; however, this is no discussion about using read information from one or more apparatus marker members (which may be separably removable from the parent publication) adheringly affixed thereto a respective publication in selected paginated series and in series for a filing system; the series of indexing-markers being machine read by such machine readable indicia thereon for the purpose of inventory maintenance and re-location and retrieval of specific articles and the physical publications for the system.

The process, according to the present invention, overcomes a number of the above problems to provide an indexing-markers system of labelling consisting of marker members which may be conveniently removable from a publication by a user-consumer which not only permits identification within a publication and ease in re-location of specific information within a respective publication, but also permits machine reading of information from one or both faces of the double-faced apparatus marker members. In this reading of the index-marker's readable information, a computer may be programmed with assigned machine readable indicia to each marker member or face thereof, in accordance with data input of the read information, to read and/or apply subsequent machine readable information to each sub-field of each selected apparatus marker member before, during or after such indexing-markers adherence to the border margin of its respective publication. U.S. Pat. No. 4,204,639 discloses the use of additional labels applied to a file folder being of the color coded type to provide all the attendant advantages thereof. The same patentee, Barber, in U.S. Pat. No. 4,329,191 defines a process for labelling a system of file folders which comprises printing a set of indicia in a single field on one face of a pressure sensitive permanent label, where the indicia is both machine and visually readable and a mechanical labeller is programmable to control the application of labels to the same file folder by the input from such machine reading step in application of individual color coded labels to the file folder flap, where each color-code represents one label as applied, has an indicium corresponding to one of the machine read indicia. Further, Barber's U.S. Pat. No. 4,580,815 discloses a composite strip for the subsequent application of a discret series of labels applied to such composite strip before its application to the edge of the substrate; the composite strip advantageously used in combination with a tab extension to provide an add-on assembly. Barber shows limitations in the above cited disclosures mentioned which specifically define the application of labels, each with a single color-code, for alphabetically labelling specifically file folders, namely. However, there is no discussion about using read information to regulate by identifying input directing an indexing marker's application to specific predetermined placement in series on a respective publication's selected border margins, controlling from such reading step a user's application of sequentially selected marker members for inventory maintenance purposes including re-location and retrieval of information contained within various types of publication information-containing vessels of which file folders are excluded from the defined claims herein and from the target category of articles named—publications. The present invention further provides an indexing system which is compatable to both file drawer system and shelf file storage receptacles; by comparison, Barber, is only concerned with a labelling system for "shelf file folders" of which his patented specifications restrict, respectively.

SUMMARY OF THE INVENTION

A process for serially index-marking a system of publications for file of paginated and non-paginated types comprises imprinting directly one or both faces of marker members or by application of an imprinted label to indirectly apply the field information to a marker or its faces. Each of the marker members having one or both primary and secondary sub-fields where each field comprises at least one pair of readable indicia elements having mutually corresponding elements to each pair. Each readable pair of indicia elements imprinted to a marker member for a certain publication is differentiated from other publication markers for the same publication and different publications for the system by assignement of different pairs of readable indicia to each marker member being peculiar to and representative of each marker. The pairs of indicia imprinted and carried in the field or fields consist of one machine readable indicia element to the indicia pair with one corresponding visually readable indicia element; the indicia pair of elements having a pre-determined associative relationship to each other. The fields of indicia pair or pairs imprinted are predetermined to appear readable on at least one pre-selected marker surface which may extend beyond the physical edge of the respective publication. In the process operation imprinting the pair or pairs of readable indicia in either the primary field, sub-field or both and orienting the fields for machine reading across the marker's surface of the pre-selected marker's at least one face. Before, during or after adheringly mounting a marker to a border margin of a respective publication, adheringly applying one or more labels to the marker's at least one faces; the imprinted label in one version may be folded about an imaginary fold line along its predetermined dimension in application to the marker's faces to isolate at least two information fields of readable indicia pair or pairs, the two information fields being adjacent and opposite the imaginary fold line of the label. A duplicate or different field indicia is imprinted to appear on one face and reverse face of the marker member to which the label is applied provides for machine reading and visual reading of the indicia pair on both of its faces. Before, during or after adheringly mounting each marker member to the border margin adjacent the physical edge, machine entering manually or automatically by machine reading one field or fields identifying each marker. The primary field is read to identify a publication and each sub-field for identifying a particular face of a marker identifying specific articles contained within the identified publication. Controlling by such entering step the input directing an indexing-marker's application of serially imprinted marker members to specific publications for the system or specific border margins of specific publications for the system. Individual marker members having pre-determined placement by the imprinted specific code/indicia to the marker's face being the sub-field and/or color-code. Each machine readable marker member, as adheringly mounted, having machine read indicia corresponding by associative relationship to the machine entered indicia programmed for the machine for identifying selected machine readable markers of certain publications. A master color-code may be used to identify specific primary fields and subordinate color-code may be used to identify certain sub-fields and arrangement by the sequence of color arrangement.

Thus, the process of the invention provides the use of one or more indexing-markers with serial indicia for the system which are adheringly mounted to a respective publication or series of publications for the system in a simple economic manner which affords application of random, staggered or otherwise arrangements of the indexing-marker's themselves to such publication information-containing vessels for rapid re-location, retrieval and access of the physical publication and specific information contained therein which is saved, on a demand basis. Moreover, when one or more publication vessels, using the same system of serial index-marking, are stored juxtaposed in a file receptacle, the present invention eliminates the need to physically remove each and every publication from position for individual review thereof during the re-location process.

Therefore, the produced publication, in file or to the file system, has one or more serially imprinted index-markers having one or more information fields containing machine readable indicia identifying each periodical, catalog, compact disc or other forms and types of publication articles which are information-containing vessels for the system. One element to a pair of indicia elements being machine readable by the use of bar-codes, magnetic ink, electro-conductive ink, letter or numeral characters corresponding to, for example, the first letter of the publication's name and the issue date thereof. This provides ready access to a certain publication vessel desired, more particularly, to exact re-location of specific articles contained therein from stored publications in both shelf files and drawer file receptacles. Each indexing-marker or markers to a certain publication may have color-coding representing the machine readable of the primary field and respective sub-fields which may be used in a cooperating manner with each other and with the color-coding thereon the marker's face. Hence, this provides that one publication with a series of corresponding index-markers or a group of publications may be visually recognizable from other indexing-markers and from other publications in the file system due to the combination of information field coding and/or color.

BRIEF DESCRIPTION OF THE DRAWINGS

FIG. 1 is an elevational plan view of an apparatus marker for the system as a preferred embodiment in accordance with the present invention;

FIG. 2 is an elevational plan view of the apparatus marker shown in FIG. 1 showing the reverse side thereof;

FIG. 3 is a block diagram of the components of the system for serially index-marking publication information-containing vessels according to a preferred embodiment of the present invention showing fragmented publication vessels which have application of the coded marker members sequenced in arrangement thereon;

FIG. 4 is an elevational plan view of another embodiment of the marker shown in FIG. 1 illustrating the incorporation of color coding thereon;

FIG. 5 is a plan view of another embodiment of a marker with a label prior to being applied according to the invention; and, FIG. 6 is a view of another embodiment of a label for the system illustrating a label applied in another manner.

DETAILED DESCRIPTION OF THE PREFERRED EMBODIMENTS

FIG. 1 illustrates an apparatus marker member 10 for the system, showing one side of the double-faced marker imprinted directly to the face surface thereof in accordance with one of the preferred embodiments of the present invention. The marker 10 has a portion 14 or its head which is designed to extend beyond the edge of its respective publication; the stem portion **14*a* and head 14** each being configuated in pre-determined shapes of geometrical, modified-geometrical and irregular.

As can be seen, the non-adhesive marker side (shown) has a portion 14 of its face 11 where the fields are preferably locationed: primary field 25, sub-fields 26 and identification field 28, as indicated by their respective numerals. Each of the primary field and sub-fields employed has one or more pairs of corresponding indicia 30, **30*a*, where each element 30, 30*a*, to such indicia pair may be of a machine readable indicia or code type. Although both elements to such indicia pair may be machine readable, one element 30*a* is shown to be visually readable in association with its corresponding element 30. Shown adjacent and spaced from the marker's pre-determined top-edge 13 of the portion 14, FIGS. 1 and 2, is the identification field 28 illustrating placement of visually readable information such as the publication's name (ABC DIGEST); issue date (June, 1989) and volume number (Vol. 15) in this example. Though shown to be positioned above the primary field and sub-field, in the alternative, the identification field 28 may be positioned along side or below the machine readable fields 25, 26, On the reverse face 12 of the marker 10, in FIG. 2, a releasable and reusable adhesive 16 is shown to back up the non-adhesive face 11 of the same marker 10; the layout of the information fields 25, 26, and 28 being in identical arrangement, positioned head-to-head. In viewing together, FIGS. 1 and 2, it is to be seen that the primary field 25 may be carried on one or both faces of the same marker and that only the sub-field 26 or sub-fields to be utilized for sub-classification identification may be varied on each face 11, 12, thereof. The sub-field may be employed to distinguish one page from another depending upon which side of the page the marker 10 faces to identify. Accordingly, the sub-field may serve to identify different articles on front and back sides of the same page, if desired. It is further illustrated that the primary field 25 and sub-field 26 are positioned in the same latitude for convenience of continuous straight line scanning format, end-to-end. Other relative field positioning may be head-to-foot; end-to-head or end-to-foot by arrangement. Each marker 10 carries field information peculiar to itself or to its faces; the information fields jointly or independently may extend the width of the marker, FIGS. 1 and 2. As shown, both the primary field 25 and secondary sub-field(s) 26 are occupied by imprinted pairs of corresponding indicia elements 30, 30*a*; the primary field 25 to generally identify the respective publication to which it was assigned and the (secondary) sub-field 26 to specifically identify certain pages having article subject matter of a paginated publication for both manual and machine re-location and retrieval purposes by this assigned field. The visually readable element 30*a*** to the indicia "pair" may be of characters such as numeric, alphabetic or combination alpha-numeric in application to code the particular publication for the system.

A master color code 35 may be applied to a group of markers 10 identified and associated with the same respective publication by their color labelling. Subordinate color coding 37 may be used to further differentiate one marker or marker face from another for a series of markers having the same master color code. Other means of determining one group of marker from other groups, is by of course the primary field code pair indicia 30, 30*a* and perhaps by the marker head 14 portion physical configuration which may be unique and representative of their respective publication.

The fields 25, 26 and 28 consist of one or more rows or columns depending upon format arrangement and are preferrably imprinted adjacent and spaced from at least one physical edge of the marker 10. The rows contain such peculiar and readable information to each marker face or faces 11, 12. The recording and storage of the data input 42 from the machine code (bar code) reader 40 or manually entered input from element 30*a* of the indicia "pair" aid in the relocation and retrieval of the exact marker indicating the specific information at a future point in time, as needed, on a demand basis. It is the cooperation of the self-adhering marker 10 with the machine or manually entered input data into the computer coupled with the exact placement of the marker or markers to the border margin of selected pages of a paginated publication 50, FIG. 3, which permits the rapid access, retrieval and re-location to occur. In addition, a portion (stem) which mounts to the border margin of the publication 50 displays a marker face 11 in which such stem portion 14*a* may be reserved for hand-written notations in the blank area provided designed to preserve and protect the publication 50 from defacement, shown to be at the location of the stem 14*a* of the marker face 11. It may also be viewed in the block diagram that the re-location and retrieval system which uses data input entered, designated by block 42, directs the display monitor and/or the main printer designated by block 46 to produce a summary report printout of publications demanded by the search or such publications which have been removed from inventory by another party. Should the markers not have such machine readable indicia, the sub-printer indicated by block 44, being directly connected to a serial port of the data input terminal 42, is capable of producing custom at least one-at-a-time readable identification information labels without interrupting the functions of the main printer 46 in operation. These custom labels produced are applied singlarly to a single face of the marker or may wrap over the pre-determined "top-edge" 13 of the marker 10 in display of different or duplicate coding information pertinent to each side of the marker 11, 12, as further shown in FIG. 3.

As previously mentioned, one machine indicia 30 index marking with one corresponding visually readable indicia element 30*a*, constituting an "indicia pair", may be utilized as a single "pair" or united to form groups of indicia pairs as in the manner shown in FIGS. 1, 2, 4, 5 and 6 which may be required to precisely identify a particular publication and markers to a specific marker series. Selected marker's faces are further illustrated by example arrangement showing the fields 25, 26, 28 extending the marker's width which was pre-determined in accordance to the physical marker's edge being deemed the "top edge" 13. The primary field and sub-field indicia are imprinted relative to such pre-determined top edge of each marker for the purpose of convenience in reading the scannable information in an upright position without having to remove and/or re-arrange the physical publication in a storage position. Further, ideal location for the pair indicia is on the portion of each marker extending beyond the physical edge of the respective publication. The code illustrated for example, in FIG. 1, is a bar code defined to be "Code 39", a popular machine readable format. The code is indicated by brackets 25 and 26 to separate groups of indicia pairs in both primary field and sub-field, whereupon such machine reading activity, indicate and are representative of the "general" publication information, i.e., ABC Digest and "specific" information, i.e. articles found on specific pages of the digest. As can be seen in the primary field 25 and the sub-field 26, a machine readable indicia code 30, in this embodiment is made up image recognition markings (variated width vertical lines) which are visible to the human eye and are optically scannable by a laser wand or pencil representing the aforesaid general and specific digest subject matter to be later re-located and retrieved. During the publication search, the code is machine read or manually entered into the computer by the corresponding visually readable indicia characters for cross-searching and cross-reference convenience. The imprinted primary and sub-field indicia 25 and 26, respectively, may include other types of coding machine readable indicia from the group of magnetic ink readable indicia, alphabetic readable indicia, numeric readable indicia, alpha-numeric readable indicia, electro-conductive ink readable indicia. Another means of identifying groups of markers belonging to the same respective publication is by the use of color code, where the assignment of a master color code 35 corresponds to the primary field 25 and perhaps, if desired, the sub-field; the master color code representative of groups of marker members to the same respective publication and where the sub-field (subordinate) colors 37, as applied, correspond to readable indicia which determines the sequential order and arrangement of the marker group and each said subordinate color is different from the other to distinguish one color-coded marker member from the others to the same said respective publication, said master color code, as applied, to one or both marker member's faces, distinguishing one such respective publication from one another in a series of publications for the system to regulate an index marker's application in conjunction with the application of reading the color code or codes, as applied. A designated area or areas may be reserved on one or both faces 11 and 12 of each marker, which in FIG. 6 the embodiment shows double dots of color imprinted on the marker adjacent the identification row below. In the alternative, the entire face of the marker or perhaps only the portion which is determined to extend beyond the edge of the respective publication may be color-coded to represent the primary field with the master color-code imprint and include a subordinate color 37 to represent the sub-field as desired. Therefore, markers grouped by the same such master color-code are differentiated from each other by individual subordinate color-code or codes to the same marker. Accordingly, one of such color-code imprint corresponding to each field being arranged on selected faces of each marker member as an aid to assist to determine the order by the color sequence and machine readable indicia which corresponds thereto such primary field and sub-field color code, as applied to the marker's face or faces.

As further shown in FIG. 6, it can be noted by this embodiment that for each indicia element to an indicia pair, imprinted in a field, one row is imprinted; where each indicia element (type: machine readable and visually readable indicia) is either the same entirely across the particular row or may be randomly alternated with the corresponding indicia element to such pair indicia in code form. The primary field and sub-field or sub-fields, may be positioned either beside one another on the same rows which may extend the width of the marker face 11, and 12, or each primary field and sub-field used, in the alternative, may extend entirely or in part above or below one another should they co-exist on the same face 11 or 12 of the marker member 10.

The marker member 10, when employed for use on the respective publication from whence it was removed, should the longevity of use be a concern, is therefore preferably covered, coated or laminated on the exterior face or faces 11, 12 of each marker 10. The protective film material is applied to the marker face or faces following the imprinting of each such face. The protective film covering may be a coating of liquid substance means or a flexible and thin substantially transparent film which adhesively over-lays the marker's face surface. The film sheet material used may be acetate, polyester and the like as a polymer composite suitable for its intended use, having a suitable thickness with or without a color identification means; the flexible film may be adhesively backed facilitating pressure-sensitive adhesion permanently or semi-permanently to selected face surfaces of the marker member or markers 10. In application of the film sheet material to the selected markers 10, individual single sheets may be applied to each marker face 11, 12 thereof or in the alternative one film sheet may be folded along an imaginary (fold) line covering one edge of the marker 10 and may extend partially or entirely the marker's width with the intent to particularly protect and seal the readable recognition information located in the identification row, primary field or sub-fields, imprinted thereon the face or faces of the marker 10. Should the film sheet be used, the release carrier is removed by peeling the one side thereof away permitting exposure of the pressure-sensitive adhesive. The film sheet may be optionally applied prior to during or after such marker member is adheringly mounted to the border margin of the respective publication, permanently or semi-permanently applied to such marker member's stem portion and/or head portion 14 extending beyond the respective publication's edge the application of a flexible and thin transparent film to protect and seal one or both faces of each marker member covering such exposed marker portion subject to wear and tear including the readable indicia thereon. However, as alluded to in the aforesaid, a liquid coating as a film may be applied to the face and reverse face 11, 12 of each marker 10 during the manufacture of the apparatus which upon the curing or drying of the liquid film, the coating encapsulates the marker member 10 thus offering greater durability and longevity of the marker's structrual integrity; either of the protective film methods as applied add a resistance factor to overcome the mutilation and dog-eared corners which all to often occur to tabs in use or in file storage. In another alternative, the markers may have a protective layer laminant sandwiched therebetween two outside layers of paper or the like, for instance.

FIGS. 5 and 6 show another embodiment of the invention illustrating a pressure-sensitive label, adhesively backed, and having an imaginary fold line 22 with the fields positioned to the predetermined "top" edge of the marker for convenience in reading in file storage; a single label 20, by the use of of the fold line 22, applied to both faces of the marker 10, the figure drawings showing the primary fields postioned in the same latitude end-to-end and spaced opposite the fold line 22. Yet another embodiment in FIG. 3 shows a single label applied to only one face of the marker 10; a second label required for the reverse side face of the same marker 10. It therefore can be said that both the machine and visually readable information imprinted on each marker face or faces (two) 11, 12, is readable by one of directly imprinted means (i.e., lithographed or other surface imaging of the marker's face) and indirectly imprinted means (i.e., lithographed or other surface imaging of the label) by the application of a pressure sensitive label applied to one or both faces of each such marker. Following in the continuity of thought, the master and subordinate color code, aforementioned may also be applied directly to the face surface of selected sides of each marker member 10 or indirectly applied by way of the same or different label in application to the face surface of the marker.

As mentioned earlier, the imprinted label, should this vehicle be used, is directed to a pre-determined edge of the marker member by its imaginary fold line 22 should a single label be used. The imprinted label is applied to a marker member by locating and positioning it on such marker member faces with one or more fields positioned upright respective to the manner in which respective publication is filed facilitating reading convenience from either direction; the marker's predetermined "top edge" 13 is relative to the field or fields being positioned in an upright fashion also which shall dictate the preferred manner in which such respective publication is filed facilitating reading convenience. Thus a dupilcate or different field indicia (primary or secondary field indicia, respectively) may be imprinted to appear on the reverse side of such marker member 10 permitting exposure and access from either direction while such respective publication filed, remains in storage location barring removable thereof. In view of using a label to accomplish the indirect application of the readable information to the marker's faces 11, 12, a thin protective film material may cooperatively be used to protect and seal the information face surface, the specifics of such protective film application being described earlier in this specification. In summary of the protective film material, the flexible transparent film is applied directly to the marker's face or faces or such flexible and thin transparent film is applied directly to the imprinted label's face (non-adhesive side only) prior to or after the adheringly mounting of such marker member.

In locating the primary field and sub-fields on selected faces of the marker 10, FIG. 6, both fields consists of the machine readable code corresponding to alphabetic, numeric or other identifyable recognition characters or combination thereof providing visually readable and/or manual access with the capability of data entry of such visually readable characters into the computer, to be stored in machine memory for later recall. The primary field with machine code 30 assigned represents the particular respective publication (general information) for which pre-established markers 10 are uniquely associated therewith; the machine readable code indicia 30 and corresponding visually readable indicia 30a constituing one "pair" of indicia and where one or more indicia pairs comprise each field. Each indicia element to the "pair" occupying a row within the field and where each row is co-extensive with the each other extending the length of the pre-determined field width. The visually readable indicia 30a may be positioned in the upper or lower row of the field with respect to the row selected for the imprinting of the machine readable indicia 30 and 30a. Of course, the same is held true for the sub-field which displays and represents the "specific" information pertinent to the selected marker 10 placement along the border margin adjacent the edge of the respective publication from whence such marker or markers came from or to which such markers are to become associated. FIGS. 4, 5 and 6, illustrate other alternative embodiments in keeping with the present invention which show layouts of "Code 39" as machine readable information recognition format markings corresponding to the visually readable character recognition format markings representing the subject matter of each a general and specific nature to be later re-located and accessed by the marker indexer. The adheringly mounted marker 10 acting as an "indicator" prominently displaying both the machine and visually readable indicia on the marker portion extending beyond the edge of the respective publication. The code and/or character information is either read visually (manually entered into the computer) or machine read when relocating particular publications with specific information desired, for example, an article on photography; and further provides inventory control of the publication material removed from file storage; the removed publications being listed and identified by person, publication name, issue date, volume number, and the like on a computer print-out summary sheet in record keeping maintenance of such removed publications from file.

The marker member 10, as shown in FIG. 3, is applied to the outside margin of a non-paginated publication (in this example) adjacent the edge thereof with a "portion" of such marker 10 projecting beyond the publication's edge. The marker member 10 as affixed to the publication from whence it came, becomes an integral part or extension of the physical dimension of the publication to which it is applied. It is only with such projecting "tab portion" that such a publication stored juxtaposed in file is given the advantage of being noticed with this outward projecting "tab portion" flag. Due to the greater planar surface provided by dimensional face size of each marker 10 (in comparison to the elongated and slender surface square area of the spine of a publication) such marker face surfaces 11, 12 are better able to be imprinted with the machine readable indicia coding 30 and 30a. Though the visual and machine readable coding of the primary and sub-fields 25 and 26 may be located and positioned any where on the faces of each marker member 10, the preferred location and position of such fields is the tab portion, pre-determined for use, which extends beyond the publication's edge; the positioned of the fields pre-determined to be adjacent and/or and spaced from the edge or edges of each marker and positioned pre-determined appear readable on at least one pre-selected marker's face. of the marker 10 permitting the fields to be viewed readable once the publication is filed in storage.

The machine readable code indicia 30 and 30a of the primary and sub-fields on the marker member 10, as previously discussed, designated the general information and specific information, respectively. Other subordinate sub-fields such as a tertiary field and so on may be further used as needed. The computer and/or manual methods of relocation and retrieval may be employed autonomously or synergistically to access the desired information in a timely fashion, when demand arises. As can be seen in FIGS. 1, 5 and 6, markers 10 may have primary field and/or the sub-fields repeated on the reverse face or in the alternative, the primary field may be isolated from the corresponding sub-fields which may also be isolated from the primary field 25 and from each other; where each marker face or faces 11, 12 may isolate selected fields which correspond to the respective publication. The sub-field (secondary) code indicia 26 differentiates one marker from the other and may further differentiate one marker's face from its reverse face, which may serve in practice to uniquely identify information adjacently positioned within the paginated publication 50. A series of markers 10 to the same respective publication may be identified by the use of the primary field common to each marker face or by a master color code which serves to differentiate one group of markers 10 to a respective publication from another group of markers identifying a different respective publication.

The markers 10, according to the preferred embodiment, may be imprinted and protected with an optional film layer material in a single pass through the manufacturing equipment. Though the marker readable information may be directly imprinted on the sheet material, the alternate use of the Seiko Smart Labeller, an in-line computer autonomous printer, may be employed to produce the necessary machine readable "Code 39" labels for application to the face or faces of the marker. This particular label printer is capable of producing both primary field and sub-fields consisting of both bar-code information with corresponding visually readable indicia. Other types of label printers may be used to provide adhesively-backed labels which may use other types of machine recognition readable formats other than the optically scannable graphic image format type as in a bar-code, such as electro-conductive ink recognition format, light sensitive invisible ink recognition format, .magnetic ink recognition format and the like which would provide such a machine readable capability for machine retrieval and relocation of the publication material. The machine readable indicia found in the primary field and the secondary field provides for computer-aided re-location and retrieval of the desired general and specific publication information upon demand.

The position of the primary and secondary fields may lie, in the alternative, across the length of the single marker's face being spaced from both the respective width edge and the respective side edges 13a of the marker portion which extends beyond the fore-edge of the respective publication such that the machine and corresponding visually readable indicia is readily accesible (in view) and easily scannable from a single publication removed from storage as well as from a series of respective publications vertically or horizontally stored juxtaposed in shelf files or file drawers, respectively, such that the fore-edges 52 of each publication are exposed and positioned toward the asile or upward toward the user while remaining in file. The accomplishment of this system and process is uniquely effective as it standardizes and unites under a common filing method, one universal re-location and retrieval method and process of publication information access, regardless the physical binding type since the fore-edges of each publication face the same direction in either a shelf file or a file drawer or receptacle.

Additionally, sub-fields, (i.e. tertiary field and so on) may be used on the face of each selected marker in order to identify one page, paragraph and the like, from another by the use of such readable indicia pair or pairs. In place of additional sub-fields, color-coding the entire tab face surface or portions thereof may be used permitting the differentiation of either --each marker face from one another and/or individual markers from each other to the same series of one respective publication using both master and subordinate, previously mentioned, color-coding in aiding this accomplishment.

Should the apparatus marker 10 be directly issued to the user via the publication information-containing vessel or supplied thereto as a foreign attachment in blank form (or imprinted with a pre-determined space set aside for the consumer label application) the machine-visual pair indicia is indirectly applied to the face or faces of each marker through the vehicle of the adhesive-backed pressure-sensitive label 20. The label at the time of application may be singularly applied to each face of the marker or as one label folded over a foldable line wrapping over (or banding) one or more edges of the exposed marker portion. The user may conveniently work to accomplish such an imprinted machine and corresponding visually readable label using a physical striking "key" printer or using a thermal printer sold under the trademark of "Smart Labeller" by the Seiko Corporation of Calif. This device is capable of being instructed to thermal imprint heat sensitive type label stock (paper) being adhesively-backed on a one-at-a-time basis using "Code 39" bar coding indicia as an optical recognition scannable indicia format; the machine (optical indicia) element corresponds with the visually readable indicia element forming the cross-reference retrieval "indicia pair" for manual data entry or rapid computer access of the desired publication for re-location purposes. The Smart Labeller imprints such corresponding readable characters as alphabetic, numeric or combination of each. This particular choice of printers offers both unique hardware and software as a package (IBM and MacIntosh Compatable) that delivers high-quality smear-proof labels concurrently while the computer and the main printer continue to handle other jobs without the need to exit your computer program a user is working in. It is a convenience printer to produce one-at-a-time labels when needed without interrupting the main printer. The characters produced as well as the bar-code itself are printed with technology using high-quality non-impact (non-striking) printing means being direct-thermal technology, such as a facsimile machine employs. The printer provides noiseless operation and connects to a serial port of the computer. As mentioned in the above disclosure, the imprinted labels or label may be applied to selected surfaces of the markers by hand to create a serial of marker members to the respective publication where each imprinted label is distinguishable from another label to the system and where such label represents a peculiar marker or peculiar face to a marker 10. A further variation of the selfadhering label 20 is to provide one or more color identification means having a predetermined placement and/or position on the surface of the label or from the imaginary line which even may act to split the color strip permitting the wrap-over color to be seen on from both sides of the marker 10, as shown in FIG. 5.

Turning to FIG. 3 in accordance with a preferred embodiment, the data input is either entered into the computer, designated by block 42, by means of manual entry (of the corresponding visually readable indicia) or by scanning the machine readable code indicia 30 directing the software of the computer to search in memory to re-locate particular articles, subject matter of a certain publications in file stored on hard or floppy discs. By scanning both the primary and sub-fields, of publications in the filed position, a listing of the name of the publication, issue date, volume number, etc. including the sub-listing of the specific articles of interest contained within the confines of the publication are displayed on the display monitor or directed to be printed on a summary sheet by the data input and the software in cooperation with each other. The sub-printer (Smart Labeller) 44 is activated should the markers 10 require a machine readable code indicia 30 and corresponding visually readable character indicia 30*a* for later computerized re-location and retrival, which upon receiving commands via the software the sub-printer commences to imprint a label with the "indicia pair" of corresponding elements 30 and 30*a*. The sub-printer is directed to imprint the assigned character code 30*a* along with the appropriate bar-code 30 representing such publication information for cross-reference capability during information retrieval of desired publications. Following the sub-printer's imprinting of the "indicia pairs" to create the primary field and-or sub-fields a label may be immediately peeled from the release carrier and applied to the marker's face or faces 11,12 in accordance with the aforementioned manner within this specification before or after the marker 10 is adheringly mounted to the outside border margin of the respective publication 50. In the alternative, the release carrier bearing the completed imprinted codes 30, 30*a* in a continuous strip form may be re-rolled for use later.

In use of the labels, the roll of blank labels are fed through the machine printer or Smart labeller to load the device designated by block 44. The label imprinter custom imprints both machine readable indicia 30 with the corresponding visually readable character indicia 30*a* along with start-stop machine indicia which opens and closes the machine reading cycle, respectively. The user peels away each custom imprinted label and adheringly applies such labels to desired faces of each marker 10, in the manner specified, before, during or after each marker 10 is adheringly mounted to the border margin adjacent the edge of the respective publication 50. The imprinted marker 10 or each label 20 applied thereto being machine read or visually read and automatically or manually entered into the computer, before, during, or after the marker 10 is adheringly mounted to the respective publication 50. The sub-printer 44 has a supply of blank and/or precolor-coded labels which are on at least one release carrier means each label to and/or from the release carrier having the appropriate identification readable means to indicate the desired series of indexing markers to the publication system or to a particular publication vessel. The bar-code reader (laser wand) is adapted to signal and direct the programmed computer to log and store such a machine code representing the particular publication whereby automatically or manually entered support data can be entered in memory corresponding to the machine code or visually readable code, such as the publication name, issue date, volume number, subject classification, article title with sub-classification. The sub-printer is capable of imprinting combinations of numerals 0 through 9 and alphabet characters A through Z to correspond to the machine readable code indicia 30, for class and sub-class recording purpose. Although by scanning the machine readable code 30 rapid re-location of the desired general and specific publication information is effortlessly possible by the computer assistance, the imprinting and/or applying an imprinted label to a marker's face or faces to establish a marker or series of markers with a traceable machine/visually readable indicia pair of elements created by a sub-printer which provides a completely mechanized system for index marking publications; where each marker 10 indicating in machine and corresponding visually readable form the subject matter reserved for later reference. Together the indicia pair, 30 and 30*a*, coupled with master color 35 and subordinate color or colors 37, both a file drawer system of filing and shelf filing system, provides an enhanced form of publication reference in the art of retrieving publication information. The process and system, jointly, in application with the uniformity in filing publications having a disimilar binding type, being filed binding first, in shelf or drawer receptacle provides an advanced form in the art of using publications as current reference mediums.

Before, during or after the application of the marker or markers 10 to the outside border margin of the publication adjacent the edge thereof, the custom imprinted system label is adheringly applied to the face or faces 11 and 12 which may wrap-over one marker edge of selected markers 10, where the publication with its one or more series of projecting markers 10 is identifiable by one or more markers to such series; selected markers and their respective faces 11 and 12 being individually scanned by the bar-code (machine) reader 40 or interpreted by the visually readable character indicia 30*a* element of the indicia pair; either readable indicia 30, 30*a* entered as data for the purpose of being initially logged in memory (computer) or to re-locate particular publications through a summary report generated by the software of the computer in cooperation with the computer memory. Upon the establishment of the markers 10 to a virgin publication to the system the fields 25 and 26 are read where the publication 50 is routed to its position in file. Likewise, a respective publication to the system, once removed from its position in file, is redirected and re-routed to its original location in file by the field reading.

As discussed, the computer memory can store specific (article) information on a sub-listing directory beneath the main listing of the general (publication) information pertaining to the subject matter to be saved providing the user with an abstract summary report of the material in search of retrieval. On recall, the computer will display on the image monitor or be commanded to print out a summary report both with the general and specific listings along with the corresponding readable fields for cross-reference purposes to indicate their presence and their status whereabouts, as a certain publication may have been checked out by a researcher (whose name is logged by a matter of record in the computer memory including the date and time of removal from file) from the publication inventory.

For purposes of inventory and/or check out control, instead of reading the elements to the indicia pair consisting of the machine readable indicia 30 and the visually readable indicia which are mutually corresponding to each other, such as on the marker 10 and label 20 applied to the marker 10 face or faces 11,12, of FIG. 3, the needed information may be taken from the indentification field 28 being of the visually readable type and located and imprinted on the marker face or label in accordance to the positioned earlier described, by simply reading the publication's name, issue date as shown in FIG. 1, where the pertinent information is shown to be imprinted in both primary and sub-fields and positioned head-to-head relative to the field on the reverse face 12.

The imprinted elements to the indicia pair or pairs may also be read in regulating by identifying through such reading step the input directing an indexing marker's application to specific pre-determined placement on a respective publication border margin of individual cooperating marker members to the system, where each machine readable marker member as adheringly mounted having a read indicium corresponding to preassigned indicia of the selected machine readable marker 10. As with the process of FIG. 3, the label 20 may have its graphic image bar-code 30 or the corresponding numeric characters 30*a*, machine read and, according to the index marker's program, build a series of sub-field machine readable information pertinent to the need of marking a respective publication for the purpose of generating additional machine readable markers 10 the respective publication. With the marker shown in FIG. 1, the numbers 2,8,5,5,6,7 in the primary field 25; the numbers 0,6, of the sub-field 26 to represent the month of June, as both sets of numbers are machine readable and also assigned to the particular respective publication 50; color coding may be optionally applied and provided on the marker's surface and/or surfaces 11,12 of the of uniquely color coded on at least one selected edge or edges thereof; in spot color form as a strip, band, dot, area and the like or as an entire background color to the marker face; or applied across the imaginary line 22 of a label 20 which wraps over the marker edge 13, so as to split the color on both faces of the marker 10. Other examples of marker color coding are shown in FIGS. 5 and 6.

Referring to FIG. 6, a further variation in the imprinting arrangement, according to this invention is illustrated. An imprinted marker surface 11, has been prepared where the primary field 25 is shown isolated by itself; such field is arranged first in order sequence from the pre-determined "top-edge" of the marker 10 followed by the identification field 28 consisting of one or more rows which carries the imprinted visually readable publication information: publication name, issue date, volume number, etc. As illustrated the sub-field 26 may be located and positioned on the reverse face 12 of the marker 10 so as to be individually placed and isolated from the primary field 25 if desired. This arrangement may also be used with the imprinting of the label 20 or labels which may be applied to one or both faces of selected markers 10. For a publication filing system, a series of markers to the same respective publication may be either produced with direct imprinting or prepared by the application of labels where each marker to the series is peculiar to its own data and is different from all other markers to that particular series. This series arrangement is of particular interest and both practical and functional where a paginated publication having numerous pages and a consumer interest in multiple articles worthy of accessing and retrieving following re-location thereof at a future point in time. In any event whether one marker 10 is solely used on a non-paginated publication or a series of markers used on a paginated publication the markers 10 with the imprinted information thereof (directly or indirectly) is used to regulate by identifying and controlling from such reading step the field indicia and informations thereon the application of machine readable markers adheringly mounting the the outside border margin 51 adjacent the respective edge 52 of the publication 50.

The marker or series of markers to this invention therefore provides one or more markers for a publication and to a series of publications for the system where the machine readable code indicia 30, 30*a* is readily identifiable from either side of the marker faces 11, 12 adheringly mounted to the publication along the border margin thereof. The machine readable code selected for use or bar-code as displayed in the drawings is indicative of the assigned indicia directing a marker 10 to its sequenced position on the paginated publication and the overall sequenced position of the particular publication in file with other publications of a similar type for the same system. The marker face or faces may also carry a code which is machine readable and representative of the specific (article) information worthwhile saving and re-locating indicated by one or more sub-fields employed for the system. The computerized code which may be in optical, magnetic, electro-conductive ink or light sensitive recognition format can be machine read to facilitate computerized regulation by identification and control of the publication self files without the need for a machine readable file folder as described in U.S. Pat. Nos. 4,240,848 and 4,329,191. This process therefore provides a machine readable add-on marker assembly system which transforms a paginated and non-paginated publication information-containing vehicle into a self-file vehicle for immediate information access upon demand. The information is entered into computer memory storage by reading the machine code, or manual entry thereof, coupled with the programming software to generate a screen display summary or summary sheet from the main printer with corresponding fields of indicia indicating the general and specific information in roster form to record relative information of each particular publication required in inventorying and tracking the information vessel whereabouts.

Although several preferred embodiments of this invention have been highlighted and illustrated both in written and drawing form, it will be understood to all those skilled in the art that some departures and variations may be incorporated thereto without obviating the spirit and/or the scope of the appended claims which follow.

Obviously, many modifications and variations of the present invention are possible in light.

However, it is with the embodiments of the invention which are claimed, in view of the variations which may become apparent, that claimant defines the exclusive right to intellectual property or privilege as follows:

What is defined and claimed herein is:

1. A process for serially index-marking a system of publications, comprising imprinting marker members for the system on one or both faces of each said marker thereof;

each of said marker members having a primary field and at least one sub-field on at least one marker's face thereof, each of said primary field and said at least one sub-field further comprising at least one pair of corresponding readable indicia where each imprinted marker member for a certain publication is differentiated from other publication marker members for the system by assignment of different pairs of readable indicia to each member;

each said pair of indicia imprinted and carried in said fields consisting of one machine readable indicia with one corresponding visually readable indicia having a pre-determined associative relationship, said fields of indicia pairs imprinted are pre-determined to appear readable on at least one pre-selected marker surface which extends beyond the physical edge of the respective publication;

in the process operation imprinting the pairs of readable indicia in both said primary field and said at least one sub-field and orienting said fields for machine reading across the marker's surface of said pre-selected marker's at least one face;

adheringly mounting each selected said marker member to the border margin adjacent the physical edge of the respective publication relative to the pre-selected storage receptacle type;

machine reading first said primary field thereon for identifying a publication from one said face of one said selected marker member and machine reading secondly said sub-field thereon for identifying and being specific to articles contained within said identified publication, regulating by identifying through such reading step the input directing the user to re-locate and retrieve both certain said identified publication and certain markers to such identified respective publication for the system;

a master color-code representing one group of said marker members representing said identified publication and/or said primary field, and said process making each marker and each said respective publication for the system distinguishable from each other by their imprinting.

2. A process of claim 1 wherein the primary field is at least one of an isolated field and carries said at least one sub-field as a part thereof.

3. A process of claim 1 wherein each said sub-field is corresponding to at least one subordinate color-code.

4. A process of claim 1 wherein only each said sub-field is corresponding to a color-code thereto.

5. A process of claim 1 wherein said sub-field is peculiar to each said marker member or to each marker's face.

6. A process of claim 1 wherein said markers are adheringly mounted to said respective publication by at least one of from whence they came and/or for which they are processed.

7. A process of claim 1 wherein said machine readable indicia is read by at least one of before, during or after such markers are adheringly mounted to their said respective publication.

8. A process of claim 1 wherein said field carried machine readable indicia being applied to either or both faces of a marker by one of directly imprinting means to such face and indirectly by the application of such imprinted pressure sensitive label applied thereto.

9. A process of claim 8 wherein said imprinted label is at least one of a sheet label and/or a sheet label folded about an imaginary fold line along its predetermined dimesion in application to the marker's face to isolate at least two said fields of machine readable indicia thereon said marker member where each of said at least two fields being adjacent and opposite said imaginary fold line of said label and wherein a duplicate or different field indicia is printed to appear on one face and reverse face of said marker member to which the label is applied provides for machine and visual field reading of said marker member on both of its faces.

10. A process of claim 1 wherein before, during or after adheringly mounting such marker member to said border margin of said respective publication, applying to such marker's head portion and/or stem portion the application of flexible and thin film covering means to protect and seal one or both faces of said marker member.

11. A process for serially index-marking a system of file markers for publications, comprising imprinting marker members for the system on selected faces thereof, where machine readable indicia distinguishes one imprinted marker member from other marker members to the same publication and different publications for the system;

each of said marker members having at least one machine readable information field contained on at least one face thereof, said machine readable information field consisting of at least one pair of indicia elements which are both carried and imprinted in said information field, where said indicia pair of elements consisting of at least one machine readable indicia element and at least one visually readable indicia element are mutually corresponding to each other;

machine entering such imprinted readable indicia for identifying selected faces of selected markers for certain publications and controlling by such entering step the input directing an indexing-marker's application of serially imprinted individual marker members to specific publications for the system, said individual marker members being adheringly mounted with pre-determined placement on a respective publication's border margin adjacent the edge thereof, where each of such publications having at least one marker for the system; and each machine readable marker member, as adheringly mounted, having machine read indicia corresponding by associative relationship to said machine entered indicia for identifying selected machine readable marker members of certain publications.

12. A process of claim 11 wherein each of said indicia elements are at least one of both machine readable and only one indicia element is machine readable.

13. A process of claim 12 wherein said machine readable indicia element is entered by at least one of before, during or after such marker member is adheringly mounted to said certain publication.

14. A process of claim 11 wherein said machine readable indicia element and said visually readable indicia element each occupy at least one row carried within said information field.

15. A process of claim 11 wherein said machine readable indicia element and said visually readable indicia element each occupy at least one column and/or row carried within said information field.

16. A process of claim 11 wherein a certain master color-code employed identifies a specific primary field, wherein each subordinate color-code employed is different from said certain master color-code and is peculiar to each sub-field.

17. A process for serially index-marking a system of file markers for publications, comprising imprinting at least one label having application to at least one face of a marker member for the system, said label carries on its face at least one machine readable information field having machine readable indicia distinguishing one imprinted labelled marker member from other labels applied to marker members to the same publication and different publications for the system;

each of said labels for the marker's faces having said machine readable information field consisting of at least one pair of indicia elements which are both carried and imprinted in said machine readable information field, said indicia pair of elements consisting of a machine readable indicia element and a visually readable indicia element being mutually corresponding to each other;

machine reading said imprinted label having machine readable indicia thereon for identifying selected faces of selected markers for certain publications and controlling by such reading step the input directing an indexing-marker's application of at least one serially imprinted label identifying specific marker members to certain publications for the system, said individual marker members being adheringly mounted with pre-determined placement by the label's specific indicia code to selected border margins of a respective publication adjacent the edge thereof, where each of such publications having at least one marker for the system; and each machine readable label to a marker member, as adheringly mounted having machine read indicia corresponding by associative relationship to machine entered indicia for identifying selected machine readable marker members of certain publications.

18. A process of claim 17 wherein said label's specific indicia code is at least one of at least one subordinate color-code and at least one sub-field.

19. A process of claim 17 wherein by at least one of before, during or after adheringly mounting such marker member to said border margin of said respective publication, applying said imprinted machine readable label to the head portion and/or stem portion thereof said marker member face.

20. A process of claim 19 wherein by at least one of before, during or after applying said imprinted machine readable label to said head portion and/or stem portion of said marker member, optionally applying to said label the application of flexible and thin film covering means to protect and seal said label's surface thereof.

21. A process of claim 17 wherein said machine readable indicia is machine recognition format from the group of scannable image format, magnetic ink recognition format and electroconductive ink recognition format.

* * * * *